US010870187B2

(12) United States Patent
Hyust et al.

(10) Patent No.: US 10,870,187 B2
(45) Date of Patent: Dec. 22, 2020

(54) MULTI-FUNCTIONAL WRENCH

(71) Applicant: KIRK WRENCH LLC, Canton, OH (US)

(72) Inventors: Kirk W. Hyust, Canton, OH (US); Karl H. Beitzel, Canton, OH (US)

(73) Assignee: KIRK WRENCH LLC, Canton, OH (US)

( * ) Notice: Subject to any disclaimer, the term of this patent is extended or adjusted under 35 U.S.C. 154(b) by 207 days.

(21) Appl. No.: 15/817,894

(22) Filed: Nov. 20, 2017

(65) Prior Publication Data

US 2019/0152026 A1 May 23, 2019

(51) Int. Cl.

| | |
|---|---|
| ***B25B 13/48*** | (2006.01) |
| ***B25B 13/46*** | (2006.01) |
| ***B25B 23/16*** | (2006.01) |
| ***B25B 23/00*** | (2006.01) |

(52) U.S. Cl.

CPC ..... *B25B 13/481* (2013.01); *B25B 13/462* (2013.01); *B25B 13/465* (2013.01); *B25B 23/0028* (2013.01); *B25B 23/0035* (2013.01); *B25B 23/16* (2013.01)

(58) Field of Classification Search

CPC . B25B 13/481; B25B 13/462; B25B 23/0028; B25B 23/0035; B25B 23/16; B25B 13/465

USPC ..... 81/177.8, 177.9

See application file for complete search history.

(56) References Cited

U.S. PATENT DOCUMENTS

| | | | | |
|---|---|---|---|---|
| 174,745 | A | 3/1876 | Squire | |
| 1,077,575 | A * | 11/1913 | Wutke | B25B 23/0035 81/165 |
| 1,320,137 | A * | 10/1919 | Gunn | B25B 13/463 81/177.85 |
| D56,945 | S * | 1/1921 | Piotrowski | D8/28 |
| 1,384,887 | A | 7/1921 | Burndahl | |
| 1,400,285 | A | 12/1921 | Hart | |
| 1,529,075 | A * | 3/1925 | McIntyre | B25B 13/04 81/124.3 |
| 1,568,442 | A | 1/1926 | Carver | |
| 1,840,685 | A | 1/1932 | Witherup et al. | |
| D103,579 | S * | 3/1937 | McNaught | 81/124.4 |
| 2,804,794 | A | 9/1957 | Stang | |
| 3,715,937 | A | 2/1973 | Cade et al. | |
| 5,870,932 | A | 2/1999 | Brooke | |

(Continued)

OTHER PUBLICATIONS

Author Unknown, picture of 3 wrenches with two labeled "Stanley", webpage, date unknown, 1 page, publisher unknown, found on the internet Oct. 28, 2015.

(Continued)

*Primary Examiner* — Hadi Shakeri

(74) *Attorney, Agent, or Firm* — Hudak, Shunk & Farine Co. LPA

(57) ABSTRACT

A multi-functional wrench having an adjustable construction and including i) a ratchet mechanism that can be disposed at a plurality of different angular positions with respect to a body of the wrench and ii) a plurality of sockets which are useful for many applications and can accept various bits or tools engageable within the socket. The multi-functional wrench has a body that is archial or curved in shape which is a particular benefit when the wrench is used in difficult to reach areas.

12 Claims, 9 Drawing Sheets

(56) References Cited

U.S. PATENT DOCUMENTS

| | | | | |
|---|---|---|---|---|
| 6,131,494 | A * | 10/2000 | Quenneville | B25B 13/02 81/125.1 |
| 8,230,766 | B2 * | 7/2012 | Chang | B25B 13/461 81/125.1 |
| 8,474,353 | B1 * | 7/2013 | Thoman | B25G 1/063 81/177.6 |
| 8,485,072 | B2 | 7/2013 | Swing | |
| 8,511,206 | B2 * | 8/2013 | Hong | B25G 1/063 81/177.8 |

OTHER PUBLICATIONS

Author Unknown, picture of wrenches labeled 35-1 to 37-8, webpage, date unknown, 1 page, publisher unknown, found on the internet Oct. 28, 2015.

Fire Fighter Equipment Store, Akron #19 Universal Suction Spanner Wrench, webpage, date unknown, 1 page, found on the internet Oct. 28, 2015.

General Tools & Instruments, 140XL Basin Wrench Large Jaw, webpage, date unknown, 1 page, found on the internet Oct. 28, 2015.

* cited by examiner

MULTI-FUNCTIONAL WRENCH

FIELD OF THE INVENTION

The present invention relates to a multi-functional wrench having an adjustable construction and including i) a ratchet mechanism that can be disposed at a plurality of different angular positions with respect to a body of the wrench and ii) a plurality of sockets which are useful for many applications and can accept various bits or tools engageable within the socket. The multi-functional wrench has a body that is archial or curved in shape, which is a particular benefit when the wrench is used in difficult to reach areas.

BACKGROUND OF THE INVENTION

Ever since the existence of nuts and bolts, inventors have been creating wrenches that can be utilized to manipulate the same. Many different types and styles of wrenches are available and some antique wrenches are highly collectable based upon their fanciful constructions. Examples of various wrenches are set forth in the following documents. U.S. Pat. Nos. 174,745; 2,379,536; 1,384,887; 1,568,442; 1,840,685; 2,804,794; 3,715,937; and 5,870,932.

Various wrenches having heads that pivot with respect to the wrench's handle axis for adjusting fasteners in difficult to reach areas are known. Some existing pivotal-head wrenches are attached to a handle at a pivot joint so that a user may adjust the angular position of the head relative to the handle. Some of the wrenches may include a locking mechanism for fixing the head portion in a desired position with respect to the handle.

SUMMARY OF THE INVENTION

In view of the above, it would be desirable to provide a wrench that is adaptable and able to manipulate nuts and bolts in difficult to reach locations. It would also be desirable to provide a multi-functional wrench which has a ratchet mechanism that pivots with respect to the wrench's body.

The above-noted problems are solved by the multi-functional wrench according to the invention. In one embodiment, a multi-functional wrench is provided having a body, preferably an archial or curved body, having a first working face on one side of the body and a second working face on a second side of the body, preferably opposite or substantially opposite the first side, wherein a socket is present within each of the first working face and the second working face.

In still another embodiment, the present invention provides a multi-functional wrench having an archial body that comfortably fits the hand of a user. In some embodiments, the wrench body is provided with a side surface having alternating flat and archial areas which create desirable ergonomics and allow the user to create torque necessary to adjust or manipulate a workpiece such as a nut or bolt. The design of the multi-functional wrench allows for more precise execution of tasks and longer working time.

In an additional embodiment of the present invention, the multi-functional wrench is provided with a ratchet mechanism having a drive post or ratchet ring that is rotatable upon a ratchet mechanism pivot axis such that the drive post or ratchet ring can be disposed alternatively on each of the first and second working faces, which allows for both left and right side use of the wrench.

In various embodiments, any socket present on a working face of the body can be used to manipulate a nut or a bolt and/or accept a bit or and/or wrench head which can be used to manipulate a particular nut or bolt.

The above objects and embodiments of the invention can be combined in any suitable manner such that a multi-functional wrench of the present invention includes one or more or all of the embodiments described herein.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
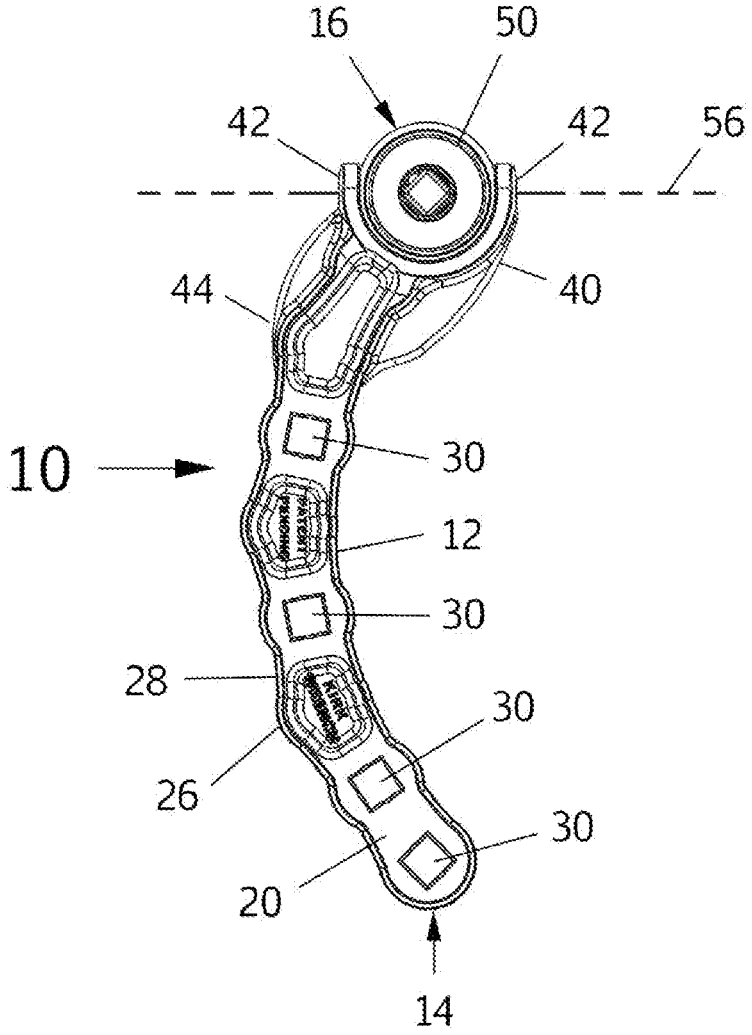
FIG. 1 is a right side view of one embodiment of a multi-functional wrench according to the present invention including a pivotable ratchet mechanism secured to an end of an archial body of the wrench.

This description of preferred embodiments is to be read in connection with the accompanying drawings, which are part of the entire written description of this invention. In the description, corresponding reference numbers are used throughout the several views to identify the same or functionally similar elements. Relative terms such as, but not limited to, "horizontal," "vertical," "up," "upper", "down," "lower", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The multi-functional wrench of the present invention has a body that is archial in shape and thus a radius of curvature, with the body including at least one ratchet mechanism and at least one socket. The wrench can be utilized in combination with a wide variety of bits or wrench heads having assorted connector fittings, either male or female, that can operatively attach the bit or wrench head to one of the sockets on the body and/or the ratchet mechanism. The design of the wrench facilitates operation in close or tight quarters. The multi-functional wrench is able to approach workpieces from a variety of different angles, even from behind.

Figure 2:
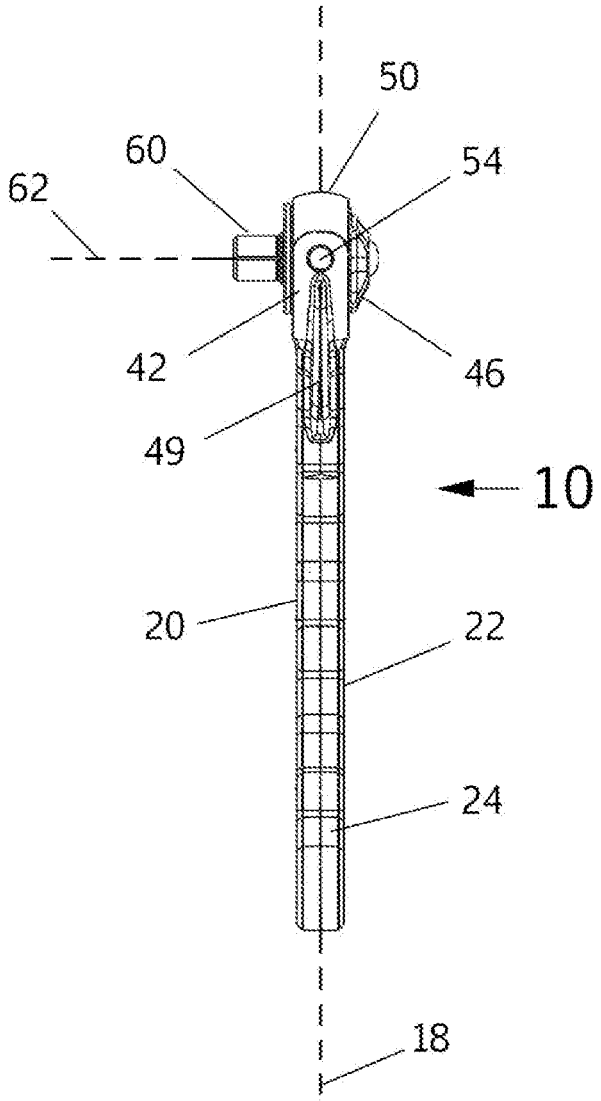
FIG. 2 is a bottom view of the multi-functional wrench illustrated in FIG. 1.

Referring now to the drawings, a multi-functional wrench 10 is illustrated in the figures, in particular FIGS. 1-9, and includes a ratchet mechanism 50 pivotally mounted to a handle or body 12, such that the angle of the ratchet mechanism 50 relative to the primary axis or plane of body 12, see for example plane 18 in FIG. 2, may be selectively adjusted.

Figure 3:
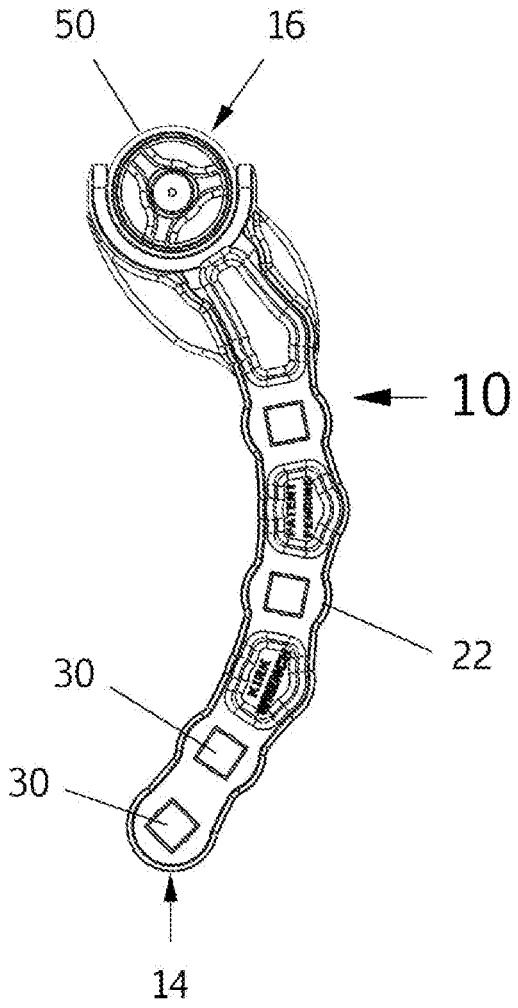
FIG. 3 is a left side view of the multi-functional wrench illustrated in FIG. 1.

Body 12 is archial or curved in shape, generally between first end 14 and second end 16, considered with reference to a working face, such as working face 20 as illustrated in FIG. 1 or second working face 22 as shown in FIG. 3. The degree of curvature can vary depending on the application of the multi-functional wrench 10. The degree of curvature can also vary along the length of the body 12, if desired. The degree of curvature provided, in some embodiments, is based upon one or more of the following features: user comfort, form that allows use of the wrench in close or tight quarters, necessary generation of torque and precise execution of wrenching activities.

As illustrated in the figures, body 12 is also provided with one or more sockets 30. In a preferred embodiment, the body includes two or more sockets 30. Four sockets are illustrated on the first working face 20 in FIG. 1. As the sockets in the embodiment are through-bores, the second working face 22 also has four sockets 30, see FIG. 3. While the sockets are not limited to any particular shape, at least one socket and preferably all sockets 30 are square sockets and able to accept a drive post, preferably a square post that can be present on an accessory such as a bit or a wrench head. Various suitable wrench heads and the like are well known in the art and described, for example, in U.S. application Ser. No. 15/217,622, now U.S. Pat. No. 10,363,649, herein fully incorporated by reference. A socket can be placed at a desired location on body 12. Body 12 of multi-functional wrench 10 includes a pair of sides 24 located between the two working faces 20, 22. One or more sides 24 can be provided with one or more ribs 26 and/or one or more flat or substantially flat areas 28. A combination of ribs 26 and flats 28 have been found to provide excellent grip to wrench 10.

Ratchet mechanism 50 is operatively and pivotally connected to body 12 through yoke 40. Yoke 40 is substantially U-shaped in one embodiment. Yoke 40 is formed by a pair of opposing arms 42, see FIG. 4 extending from second end 16 of body 12. Recessed portion 41 is formed between arms 42. Each arm 42 has a bore 46, which is a through-bore in a preferred embodiment as illustrated for example in FIG. 2. A post or pin 54 of ratchet mechanism 50 can be aligned with and extends through at least a portion of bore 46 thereby allowing ratchet mechanism 50 to rotate on a ratchet mechanism pivot axis 56 in relation to body 12. Pins 54 are journaled in bores 46, see FIGS. 2 and 5.

Figure 4:
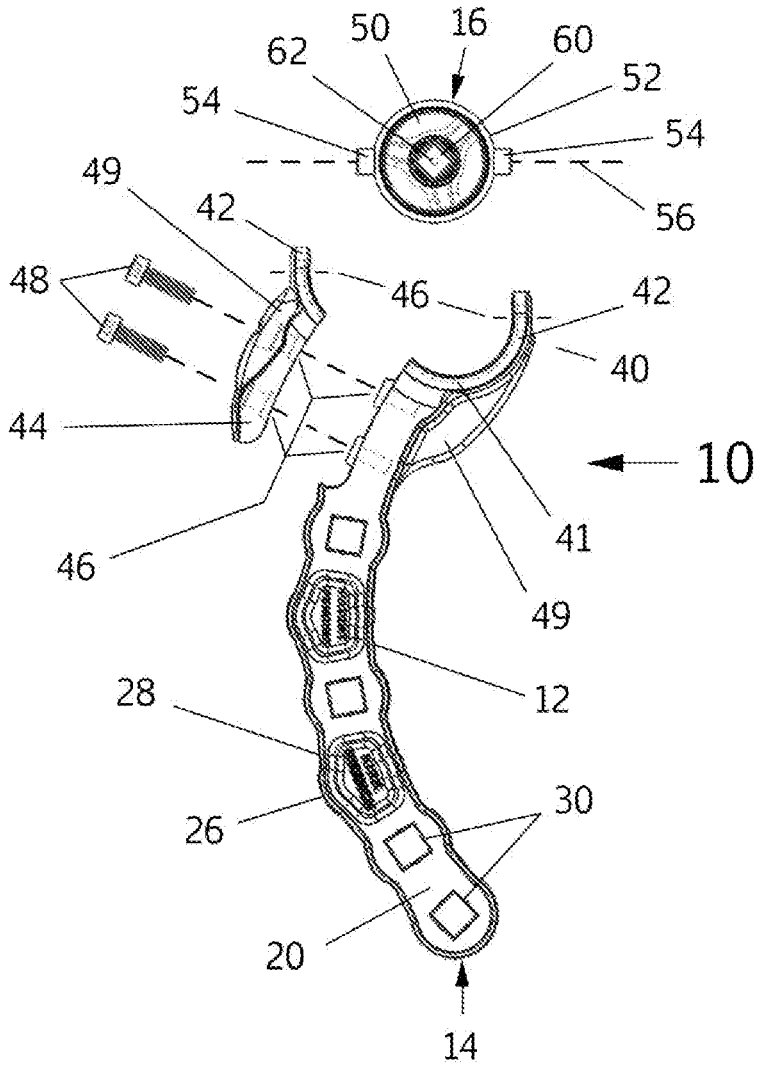
FIG. 4 is an exploded right side view of the embodiment illustrated in FIG. 1.
Figure 5:
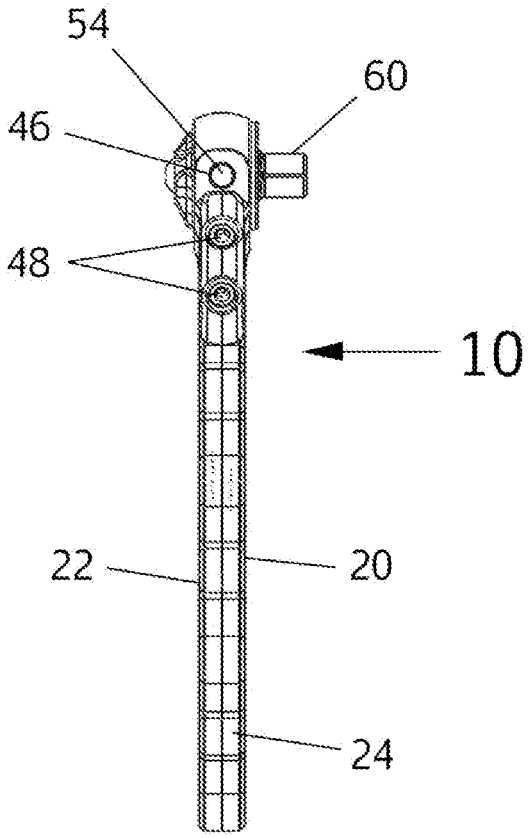
FIG. 5 is a top view of the multi-functional wrench shown in FIG. 1.
Figure 6:
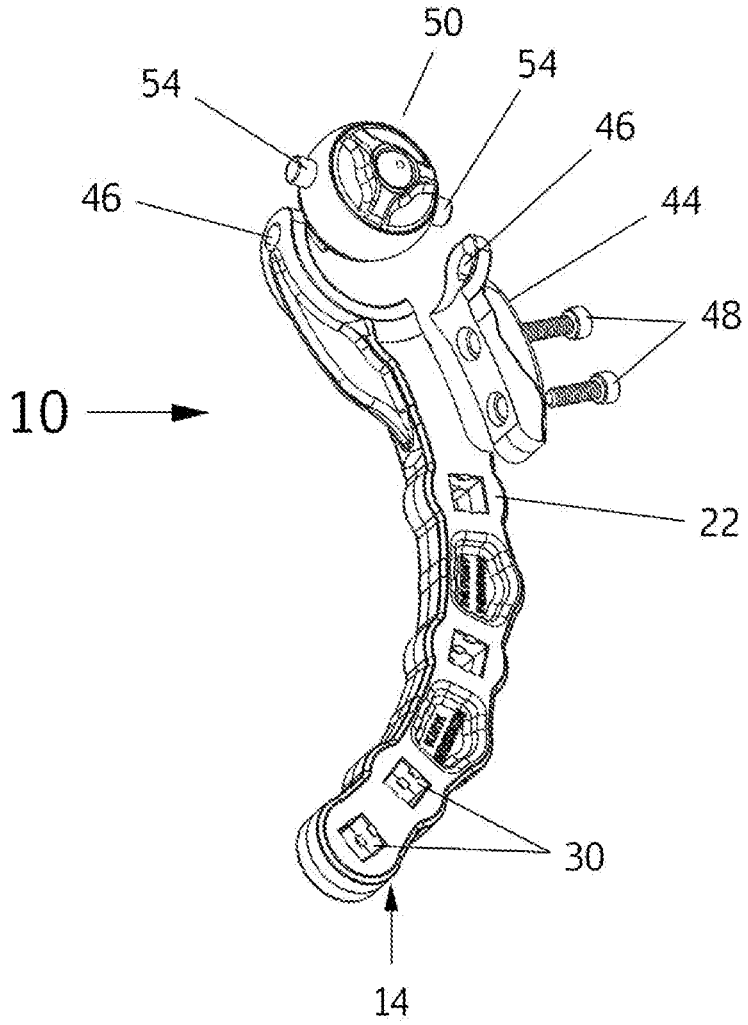
FIG. 6 is a lower left side perspective exploded view of the multi-functional wrench shown in FIG. 1.
Figure 7:
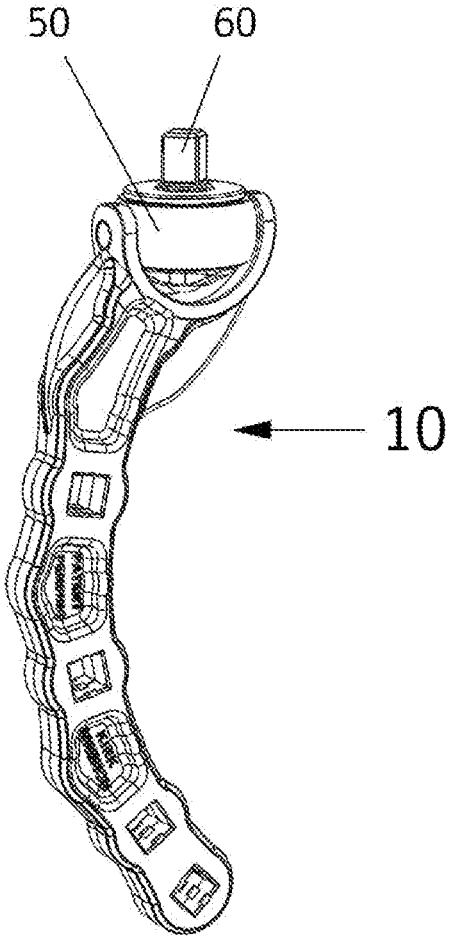
FIG. 7 is an upper right side perspective view of the multi-functional wrench shown in FIG. 1, wherein the pivotability of the ratchet mechanism has been illustrated.
Figure 8:
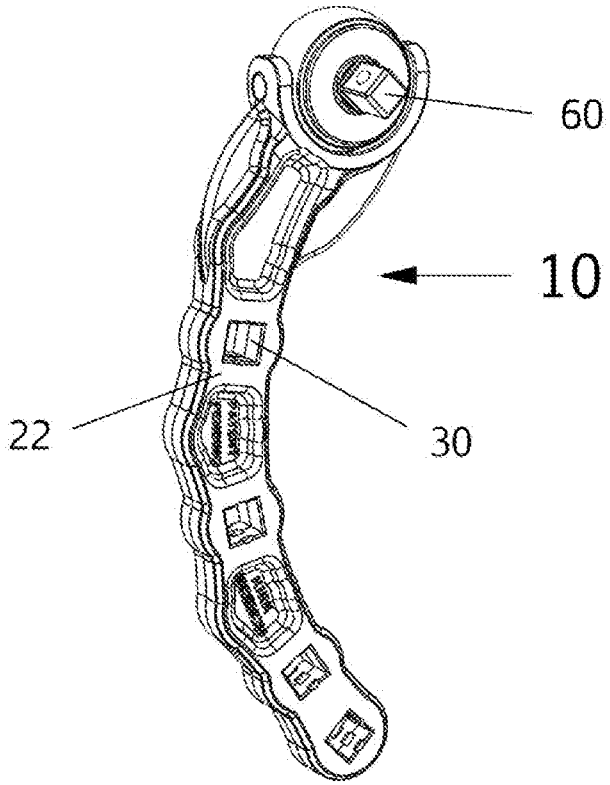
FIG. 8 is an upper right perspective side view of the embodiment illustrated in FIG.

As can be imagined from FIG. 4, the pins 54 are inserted in respective bores 46 and removable yoke segment 44 is connected to body 12 utilizing one or more fasteners 48 which are inserted through bores 46 in each of the yoke segment 44 and yoke 40. The bores 46 of the yoke 40 are preferably threaded to facilitate a secure connection between the yoke 40 and yoke segment 44. Yoke 40 also includes a pair of supports 49 in order to provide additional strength to arms 42. The supports 49 are connected at a first end to a lower portion of yoke 40 or body 12 and extend to a second, upper end of yoke 40 in order to provide strength to the assembly.

Figure 9:
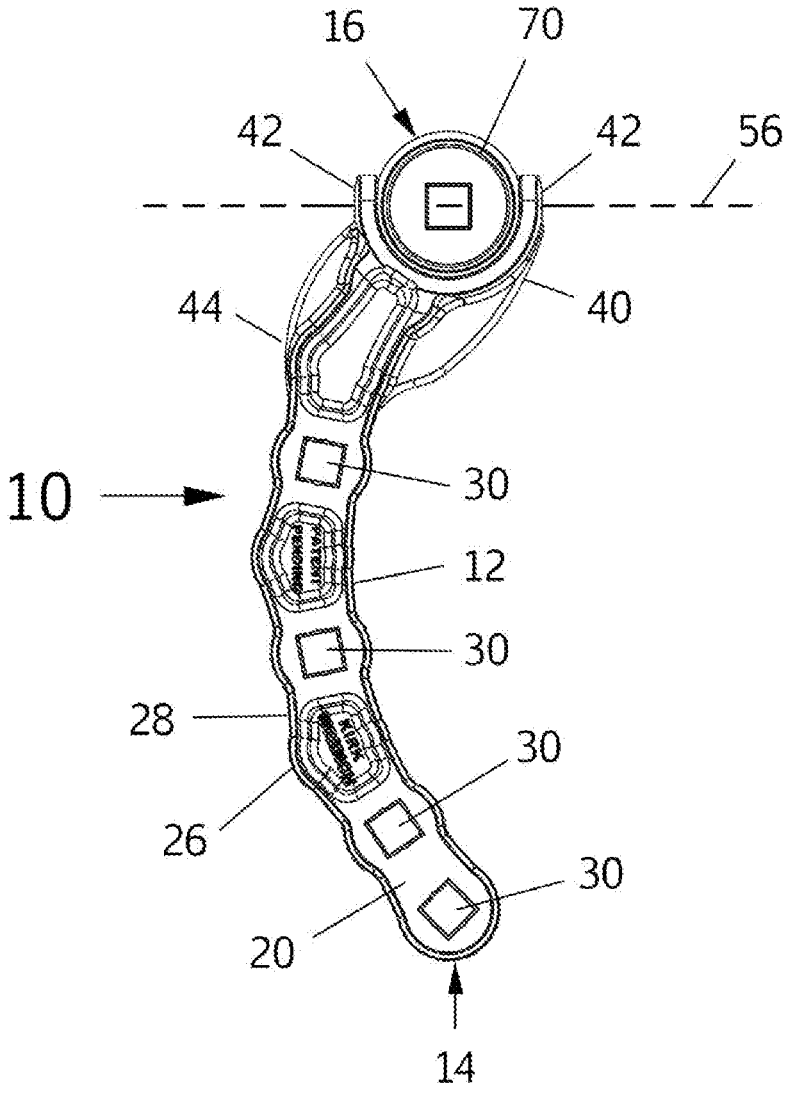
FIG. 9 is a right side view of a further embodiment of a multi-functional wrench according to the present invention including a pivotable ratchet ring-type ratchet mechanism secured to an end of an archial body of the wrench.

In view of the construction of wrench 10, it should be clear that the ratchet mechanism 50 is disposable at a plurality of different angles with respect to body 12 of wrench 10. FIGS. 1-8 illustrate ratchet mechanism 50 including a drive post 60. FIG. 9 illustrates ratchet mechanism 50 that is a ring-type ratchet mechanism, constructed as known in the art. The ratchet mechanism, whether including the drive post or a ring-type ratchet mechanism, allows continuous rotary drive motion in only one direction, while preventing a drive motion in the opposite direction. When turned in the opposite direction, the ratchet does not turn the drive, but allows the wrench to be repositioned for another turn while staying attached to the object that is acted upon. The ratchet mechanism allows for rapid manipulation of the drive, a drive head attached thereto and a component operatively connected to the ratchet mechanism in small increments without requiring the drive head to be disconnected from the component being worked on. Optionally, a switch can be built into the ratchet mechanism that allows the user to apply the ratcheting action in either direction, as needed to tighten or loosen the component being worked on. In various embodiments the ratchet mechanism can include a round gear and a pivoting, spring loaded pawl that engages the teeth of the gear. The teeth are shaped as desired to allow forward movement and restrict backward movement as known in the art. Suitable ratchet mechanisms are disclosed in U.S. Pat. No. 5,636,557, herein incorporated by reference.

In a preferred embodiment, drive post 60 is a square post which is engageable in a square socket of any of the known types of socket heads or wrenches. Drive post 60 has a central axis 62. Due to the pivotability of ratchet mechanism 50, the drive post 60 can be disposed at a plurality of angular positions with respect to the plane 18 of body 12. Drive post 60 can be adjusted between an angular position generally perpendicular to a plane 18 of the body on first working face 20 to a position also perpendicular to a plane of the body on second working face 22. Thus, the drive post 60 can be rotated from a working position on the side of first working face 20 to a position on the second working face 22. The angular position of drive post central axis 62 of drive post 60 is pivotable in a range of about 270°. Thus, the drive post 60 of wrench 10 is quite versatile and can be utilized in a variety of different working positions.

As illustrated in FIG. 9, ratchet mechanism 50 is a ring-type ratchet mechanism 70. In this embodiment, the ratchet mechanism 50 can be rotated completely about ratchet mechanism pivot axis 56 in relation to body 12. That is, the post or pins 54 of ratchet mechanism 70 are aligned with and extend through a portion of bore 46 thereby allowing ratchet mechanism 50 to rotate on ratchet mechanism pivot axis 56 in relation to body 12. Thus, the drive ring-type ratchet mechanism 70 can be adjusted between positions on both the first working face 20 and second working face 22. The ratchet mechanism 70 has a central axis 62 which corresponds to the central axis 62 of the drive post 60.

For the avoidance of doubt, the devices of the present invention encompass all possible combinations of the components, including various ranges of said components, disclosed herein. It is further noted that the term "comprising" does not exclude the presence of other elements. However, it is to also be understood that a description of a product or composition comprising certain components also discloses a product consisting of said components.

In accordance with the patent statutes, the best mode and preferred embodiment have been set forth; the scope of the invention is not limited thereto, but rather by the scope of the attached claims.

What is claimed is:

1. A multi-functional wrench, comprising:

an archial body having a first end and a second end, wherein the body has a first working face on a first side of the body and a second working face on an opposite second side of the body with respect to the first working face, wherein two or more sockets are present within each of the first working face and the second working face, wherein a ratchet mechanism having a drive post or ratchet ring is operatively connected to the body through a yoke comprising a pair of arms at one end of the body, wherein the ratchet mechanism has a ratchet mechanism pivot axis such that the drive post or ratchet ring can be disposed at at least two different angular positions with respect to the body, wherein the body is provided with a side surface on each side between the first working face and the second working face having alternating flat and archial areas, wherein the archial areas curve outwardly on each of the side surfaces, wherein at least one of the sockets is located between the archial areas on the side surfaces that are directly opposite to each other, wherein at least one of the sockets is located outside of a straight line drawn between the first end and the second end of the body, and wherein a support is present on each side surface of the body, wherein each of the supports are connected at a first end to the body with the support extending and connecting to an arm of the yoke.

2. The multi-functional wrench according to claim 1, wherein each arm has a bore, wherein the ratchet mechanism has a post or pin that extends through at least a part of the bore of each of the yoke arms thereby allowing the ratchet mechanism to rotate on the ratchet mechanism pivot axis in relation to the body.

3. The multi-functional wrench according to claim 2, wherein the drive post is present, wherein the drive post has a central axis, wherein the drive post central axis can be disposed at a plurality of angular positions with respect to a plane of the body.

4. The multi-functional wrench according to claim 3, wherein the drive post can be rotated from a position on the first side of the body and the second working face on the second side of the body.

5. The multi-functional wrench according to claim 4, wherein the drive post has a pivot range of about 270°.

6. The multi-functional wrench according to claim 2, wherein the ratchet ring is present, wherein the ratchet ring is rotatable 360° in relation to the ratchet mechanism pivot axis.

7. The multifunctional wrench according to claim 1, wherein the body has a radius of curvature along the length thereof between the first end and the second end.

8. A multi-functional wrench, comprising:

an archial body having a first end and a second end, wherein the body has a first working face on a first side of the body and a second working face on an opposite second side of the body with respect to the first working face, wherein a socket is present within each of the first working face and the second working face, wherein a ratchet mechanism having a drive post or ratchet ring is rotatably connected to the body through a yoke, wherein the yoke comprises a pair of arms, wherein the drive post or ratchet ring can be rotated from a position on the first side of the body to the second side of the body, wherein the yoke includes a removable yoke segment comprising one of the arms, wherein the yoke segment is connected to the body with one or more fasteners, wherein each arm has a bore, wherein the ratchet mechanism has a post or pin that extends through at least a part of the bore of each of the yoke arms thereby allowing the ratchet mechanism to rotate on the ratchet mechanism pivot axis in relation to the body, wherein the body is provided with a side surface on each side between the first working face and the second working face having alternating flat and archial areas, wherein the archial areas curve outwardly on each of the side surfaces, wherein the socket is located between the archial areas on the side surfaces that are directly opposite to each other, wherein the socket is located outside of a straight line drawn between the first end and the second end of the body, and wherein a support is present on each side surface of the body, wherein each of the supports are connected at a first end to the body with the support extending and connecting to an arm of the yoke.

9. The multi-functional wrench according to claim 8, wherein the drive post is present and can be rotated from a position on the first side of the body and the second working face on the second side of the body.

10. The multi-functional wrench according to claim 9, wherein the drive post has a pivot range of about 270°.

11. The multi-functional wrench according to claim 8, wherein the ratchet ring is present, wherein the ratchet ring is rotatable 360° in relation to the ratchet mechanism pivot axis.

12. The multifunctional wrench according to claim 8, wherein the body has a radius of curvature along the length thereof between the first end and the second end.

* * * * *